US011261694B2

(12) United States Patent
Turton et al.

(10) Patent No.: US 11,261,694 B2
(45) Date of Patent: Mar. 1, 2022

(54) APPARATUS, SYSTEMS, AND METHODS FOR DAMPENING A WELLBORE PRESSURE PULSE DURING REVERSE CIRCULATION CEMENTING

(71) Applicant: HALLIBURTON ENERGY SERVICES, INC., Houston, TX (US)

(72) Inventors: Simon David Turton, Kingwood, TX (US); Paul Joseph Jones, Houston, TX (US); John Singh, Kingwood, TX (US); Michael Linley Fripp, Carrolton, TX (US); Lonnie Carl Helms, Humble, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 303 days.

(21) Appl. No.: 16/490,869

(22) PCT Filed: Nov. 6, 2018

(86) PCT No.: PCT/US2018/059316
§ 371 (c)(1),
(2) Date: Sep. 3, 2019

(87) PCT Pub. No.: WO2020/096568
PCT Pub. Date: May 14, 2020

(65) Prior Publication Data
US 2021/0332664 A1 Oct. 28, 2021

(51) Int. Cl.
*E21B 33/14* (2006.01)
*E21B 34/06* (2006.01)
*E21B 41/00* (2006.01)

(52) U.S. Cl.
CPC ..... *E21B 33/14* (2013.01); *E21B 34/06* (2013.01); *E21B 41/00* (2013.01); *E21B 2200/05* (2020.05)

(58) Field of Classification Search
CPC ..... E21B 33/14; E21B 41/00; E21B 34/06; E21B 2200/05; E21B 33/00; E21B 33/13; E21B 2200/08
See application file for complete search history.

(56) References Cited

U.S. PATENT DOCUMENTS 5,201,371 A * 4/1993 Allen ..... E21B 34/06 166/325
6,244,342 B1 6/2001 Sullaway et al.
(Continued)

FOREIGN PATENT DOCUMENTS

WO WO 2017/155529 A1 9/2017

OTHER PUBLICATIONS

International Search Report and Written Opinion, dated Aug. 5, 2019, PCT/US2018/059316, 11 pages, ISA/KR.

*Primary Examiner* — Michael R Wills, III
(74) *Attorney, Agent, or Firm* — Haynes and Boone, LLP

(57) ABSTRACT

Apparatus, systems, and methods for reverse circulation cementing a tubular string in a wellbore. One such method includes reverse circulating cement slurry down an annulus defined between the tubular string and the wellbore. During the reverse circulation, a flow control device located in the tubular string is closed to prevent, or at least reduce, flow of the cement slurry from the annulus into the tubular string. The closure of the flow control device causes a pressure pulse in the wellbore. After the flow control device is closed, the reverse circulation is stopped. During a time interval between the closure of the flow control device and the stoppage of the reverse circulation, a shock absorber associated with the flow control device absorbs the pressure pulse in the wellbore so that a pressure in the wellbore is maintained within an acceptable range.

16 Claims, 10 Drawing Sheets

(56) References Cited

U.S. PATENT DOCUMENTS

| | | | | |
|---|---|---|---|---|
| 7,533,729 | B2 | 5/2009 | Rogers et al. | |
| 7,938,186 | B1 | 5/2011 | Badalamenti et al. | |
| 2002/0174988 | A1* | 11/2002 | Szarka | E21B 21/106 166/325 |
| 2003/0029611 | A1 | 2/2003 | Owens | |
| 2005/0236154 | A1* | 10/2005 | Tudor | E21B 33/124 166/308.1 |
| 2006/0042798 | A1* | 3/2006 | Badalamenti | E21B 33/14 166/285 |
| 2006/0076135 | A1* | 4/2006 | Rogers | E21B 33/14 166/285 |
| 2007/0062700 | A1 | 3/2007 | Webb et al. | |
| 2013/0264068 | A1 | 10/2013 | Hanson et al. | |
| 2015/0233207 | A1* | 8/2015 | Osborne | E21B 43/126 166/373 |
| 2016/0024876 | A1 | 1/2016 | Ward et al. | |
| 2016/0341002 | A1* | 11/2016 | McKitrick, III | E21B 34/14 |
| 2018/0283165 | A1 | 10/2018 | Gao et al. | |

* cited by examiner

APPARATUS, SYSTEMS, AND METHODS FOR DAMPENING A WELLBORE PRESSURE PULSE DURING REVERSE CIRCULATION CEMENTING

CROSS-REFERENCE TO RELATED APPLICATION

The present application is a U.S. National Stage patent application of International Patent Application No. PCT/US2018/059316, filed on Nov. 6, 2018, the benefit of which is claimed and the disclosure of which is incorporated herein by reference in its entirety.

TECHNICAL FIELD

The present disclosure relates generally to reverse cementing wellbore operations, and, more particularly, to apparatus, systems, and methods for dampening a wellbore pressure pulse during reverse circulation cementing of a tubular string in a wellbore.

BACKGROUND

Closing a flow control device at a bottom portion of a tubular string (e.g., a liner) during a reverse circulation cementing operation can present a critical risk to wellbore integrity. More particularly, the momentum of the cement slurry during reverse circulation cementing can create a high pressure pulse upon closure of the flow control device, which high pressure pulse is capable of being transmitted to the formation and may potentially result in formation fracture followed by subsequent loss of the cement slurry to the formation. These risks are especially critical in wells having narrow equivalent circulating density ("ECD") windows. The ECD is a crucial parameter for avoiding kicks and losses, particularly in wells having a narrow window between the fracture gradient and the pore-pressure gradient. It would therefore be desirable to control the high pressure pulse generated during reverse circulation cementing operations upon the sudden closure of the flow control device. Therefore, what is needed is an apparatus, system, and/or method that addresses one or more of the foregoing issues, and/or one or more other issues.

DETAILED DESCRIPTION

Figure 1:
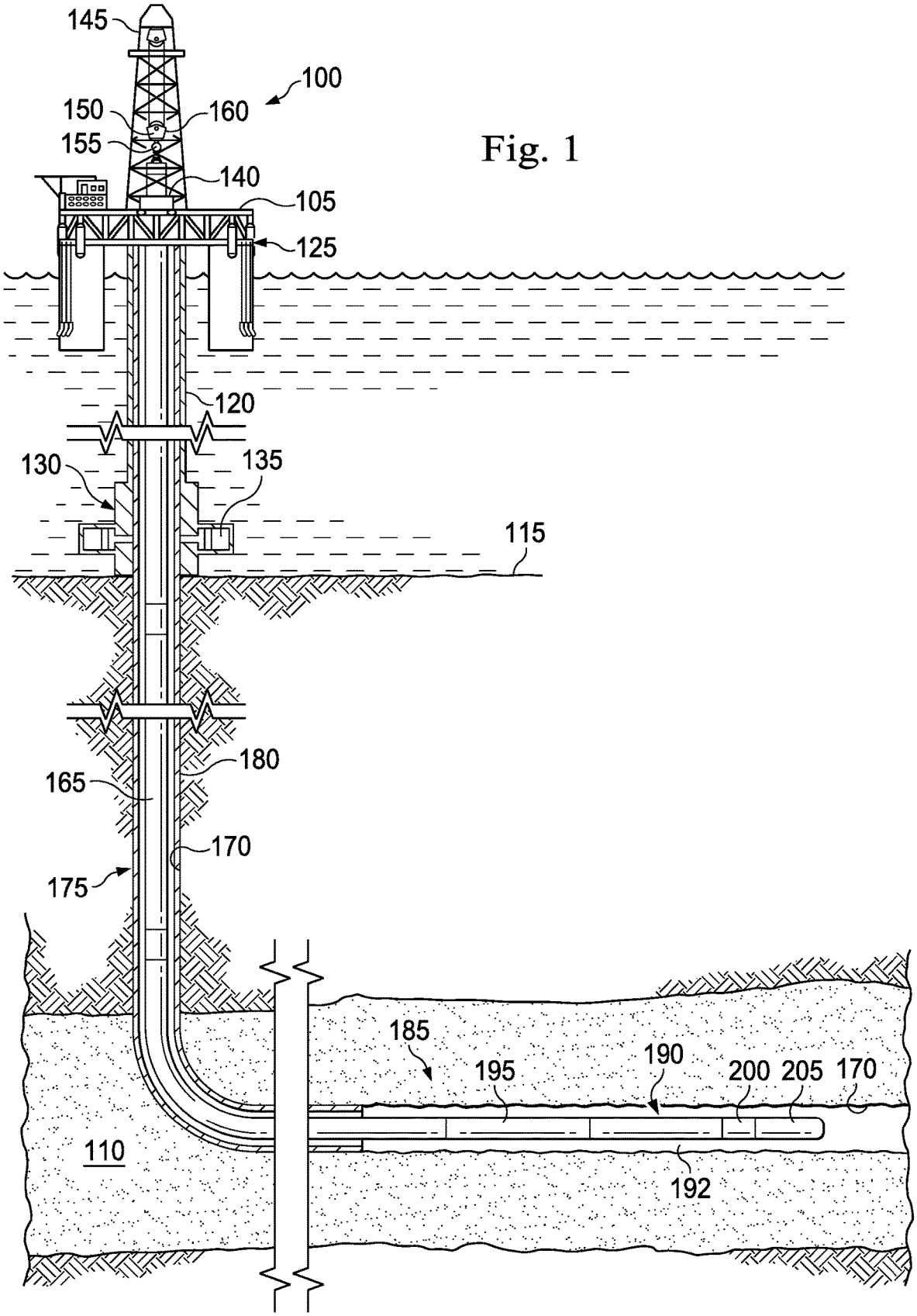
FIG. 1 is an elevational view of an offshore oil and gas platform operably coupled to a downhole tool extending within a wellbore, according to one or more embodiments of the present disclosure.

Various aspects of the present disclosure are described below as they might be employed when reverse circulation cementing a tubular string in a wellbore. In the interest of clarity, not all features of an actual implementation are described in this specification. It will of course be appreciated that in the development of any such actual implementation, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Advantages of the various aspects of the present disclosure will become apparent from consideration of the following description and drawings. The following description and drawings may repeat reference numerals and/or letters in the various examples or figures. This repetition is for the purpose of simplicity and clarity and does not in itself dictate a relationship between the various embodiments and/or configurations discussed. Although a figure may depict a horizontal wellbore or a vertical wellbore, unless indicated otherwise, the various aspects of the present disclosure are equally well suited for use in wellbores having other orientations including vertical wellbores, horizontal wellbores, slanted wellbores, multilateral wellbores, or the like. Unless otherwise noted, even though a figure may depict an offshore operation, the various aspects of the present disclosure are equally well suited for use in onshore operations. Unless otherwise noted, even though a figure may depict a cased-hole wellbore, the various aspects of the present disclosure are equally well suited for use in open-hole wellbore operations.

The reverse circulation cementing procedure of the present disclosure includes pumping a cement slurry and, in some cases, other fluids (e.g., a spacer fluid), from a surface location downhole in an annulus between a tubular string and a wellbore. Upon reaching a shoe at the bottom portion of the tubular string, the cement slurry and the other fluids turn uphole into an interior passage of the tubular string, at which point the flow of the cement slurry and other fluids down the annulus is cut off and the cement is left to set. There are distinct advantages to pumping the cement slurry and the other fluids downhole through the annulus. First, when pumping downhole through the annulus, the equivalent circulating density ("ECD") at the shoe is much lower compared to conventional cementing operations. The ECD of a well is defined as the effective density exerted by a circulating fluid against the formation that takes into account the pressure drop in the annulus above the point being considered. The ECD is calculated as: d+P/(0.052*D), where d is the mud weight (ppg), P is the pressure drop in the annulus between depth D and surface (psi), and D is the true vertical depth (feet). Second, when pumping downhole through the annulus, there is a perceptible improvement in bond logs, which are a representation of the integrity of the cement job (especially whether the cement slurry is adhering solidly to the outside of the tubular string).

Example float equipment systems that may be used in reverse circulation cementing include, but are not limited to, a double flapper stab-in system ("DFSIS") and a poppet valve pump out system ("PVPOS"). The DFSIS requires an inner string to be run in hole and stung into the float assembly to open the float assembly valves. The reverse circulation cementing operation is then performed while taking returns through the inner string. At the end of the reverse circulation cementing operation when cement slurry has filled the shoe track, the inner string is stung out of the float assembly and the float assembly valves are closed. In the DFSIS, the rig time required to run the inner string can be significant. The PVPOS includes a pump out float valve run in hole as an integral part of the tubular string. The PVPOS is activated by landing a ball on the poppet valve and shearing it from the collar. In the PVPOS, surface pressure must be held to prevent the cement slurry from equalizing between the annulus and the tubular string. In contrast, the present disclosure provides for the reverse circulation cementing of a tubular string within a wellbore while not requiring an inner string to be run in hole or backpressure to be held on the well until the cement slurry sets. In addition, when the flow control device closes, returns are no longer observable at the surface to provide an indication that the cement slurry job is complete.

Referring to FIG. 1, in an embodiment, an offshore oil and gas platform is schematically illustrated and generally referred to by the reference numeral 100. In an embodiment, the offshore oil and gas platform 100 includes a semi-submersible platform 105 that is positioned over a submerged oil and gas formation 110 located below a sea floor 115. A subsea conduit 120 extends from a deck 125 of the platform 105 to a subsea wellhead installation 130. One or more pressure control devices 135, such as, for example, blowout preventers (BOPs), and/or other equipment associated with drilling or producing a wellbore may be provided at the subsea wellhead installation 130 or elsewhere in the system. The platform 105 may include a hoisting apparatus 140, a derrick 145, a travel block 150, a hook 155, and a swivel 160, which components are together operable for raising and lowering a conveyance vehicle 165.

The conveyance vehicle 165 may be, include, or be part of, for example, a casing, a drill string, a completion string, a work string, a pipe joint, coiled tubing, production tubing, other types of pipe or tubing strings, and/or other types of conveyance vehicles, such as wireline, slickline, and/or the like. For example, the conveyance vehicle 165 may be an axially extending tubular string made up of a plurality of pipe joints coupled to together end-to-end. The platform 105 may also include a kelly, a rotary table, a top drive unit, and/or other equipment associated with the rotation and/or translation of the conveyance vehicle 165. A wellbore 170 extends from the subsea wellhead installation 130 and through the various earth strata, including the formation 110. A cased-hole portion 175 of the wellbore 170 includes a casing 180 cemented therein. An open-hole portion 185 of the wellbore 170 extends below the casing 180 (i.e., the cased-hole portion 175 of the wellbore 170), said open-hole portion 185 having been formed through the use of a drilling tool (not shown) (i.e., FIG. 1 illustrates the open-hole portion 185 of the wellbore 170 after the drilling tool has been removed). A tubular string 190 such as, for example, a liner, extends downhole from the casing 180 and into the open-hole portion 185 of the wellbore 170, said tubular string 190 being secured to a lower end portion of the casing 180 via a hanger (not shown) (e.g., a liner hanger). An annulus 192 is defined between the open-hole portion 185 of the wellbore 170 and the tubular string 190 extending within the wellbore 170. The tubular string 190 includes a downhole tool 195, a valve 200 such as, for example, a poppet valve, and a shoe 205.

Figure 2A:
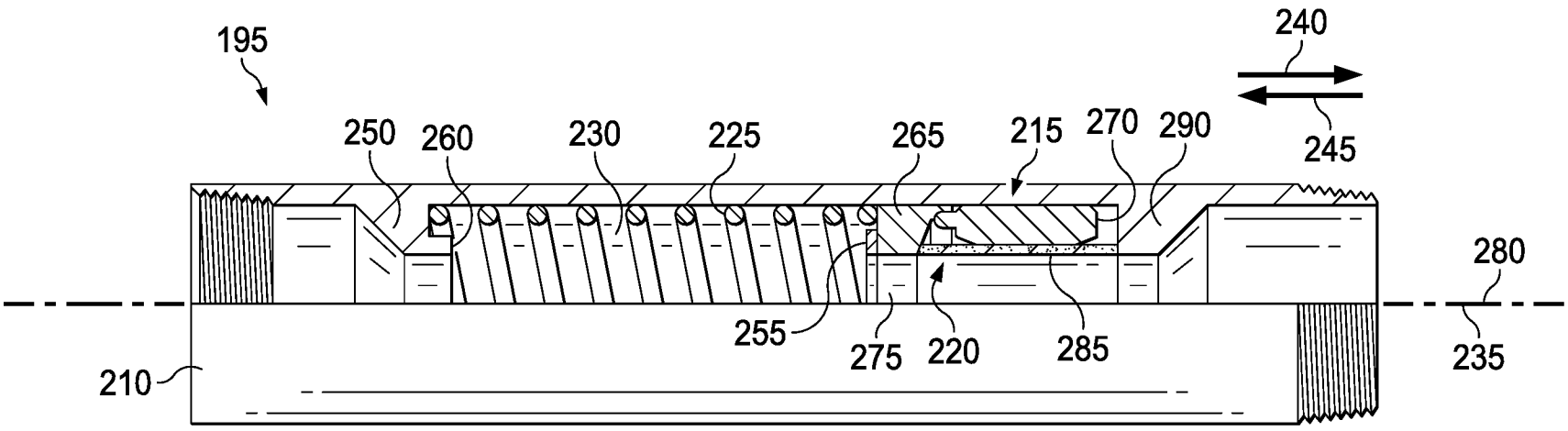
FIG. 2A is a cross-sectional view of one embodiment of the downhole tool of FIG. 1, according to one or more embodiments of the present disclosure.

Referring to FIG. 2A, in an embodiment, the downhole tool 195 includes a housing 210, a flow control device 215 (such as, for example, a flapper valve), a retainer 220, and a shock absorber 225. The housing 210 defines an internal passage 230 extending along a longitudinal central axis 235. The flow control device 215, the retainer 220, and the shock absorber 225 extend within the internal passage 230 of the housing 210. The retainer 220 is engageable to retain the flow control device 215 in a first configuration (shown in FIG. 2A), in which fluid flow is permitted through the internal passage 230 in both of opposing directions 240 and 245, and disengageable to actuate the flow control device 215 to a second configuration, in which fluid flow through the internal passage 230 in the direction 240 is permitted and fluid flow through the internal passage 230 in the direction 245 is prevented, or at least reduced.

As shown in FIG. 2A, the shock absorber 225 extends axially between the flow control device 215 and an internal chock 250, which internal chock 250 is integrally formed with, or at least fixedly attached to, the housing 210, as shown in FIG. 2A. The shock absorber 225 may be or include a spring shock absorber, a hydraulic shock absorber, an elastomeric shock absorber, another type of shock absorber, or any combination thereof. The shock absorber 225 may include shear pins or collets. The flow control device 215 is adapted to be axially movable relative to the housing 210 when a pressure pulse is applied to the flow control device 215 in the direction 245. The shock absorber 225 is adapted to dampen (e.g., when the pressure pulse is applied to the flow control device 215) the axial movement of the flow control device 215 relative to the housing 210 in the direction 245, as will be described in further detail below. In some embodiments, the flow control device 215 and the internal chock 250 include ridges 255 and 260, respectively, to keep the shock absorber 225 in position between the flow control device 215 and the internal chock 250 during the shock absorber 225's dampening of the axial movement of the flow control device 215 in the direction 245.

In some embodiments, as in FIG. 2A, the flow control device 215 is a flapper valve, which flapper valve includes a seat 265 and a flapper 270. The seat 265 includes an internal passage 275 extending along a longitudinal central axis 280. In some embodiments, the longitudinal central axis 280 of the seat 265 is coaxial with the longitudinal central axis 235 of the housing 210. The flapper 270 is pivotably connected to the seat 265. The flapper 270 sealingly engages the seat 265 when the flow control device 215 is closed (shown in FIG. 4D). In some embodiments, when the flow control device 215 is closed, the flapper 270 is spaced in a generally perpendicular relation with the longitudinal central axis 280 of the internal passage 275 of the seat 265. The flapper 270 is disengaged from the seat 265 when the flow control device 215 is open (shown in FIGS. 2A-2C and 4A-4C). In some embodiments, when the flow control device 215 is open, the flapper 270 is spaced in a generally non-perpendicular relation with the longitudinal central axis 280 of the internal passage 275 of the seat 265. In some embodiments, when the flow control device 215 is open, the flapper 270 is spaced in a generally parallel relation with the longitudinal central axis 280 of the internal passage 275 of the seat 265.

Figure 2B:
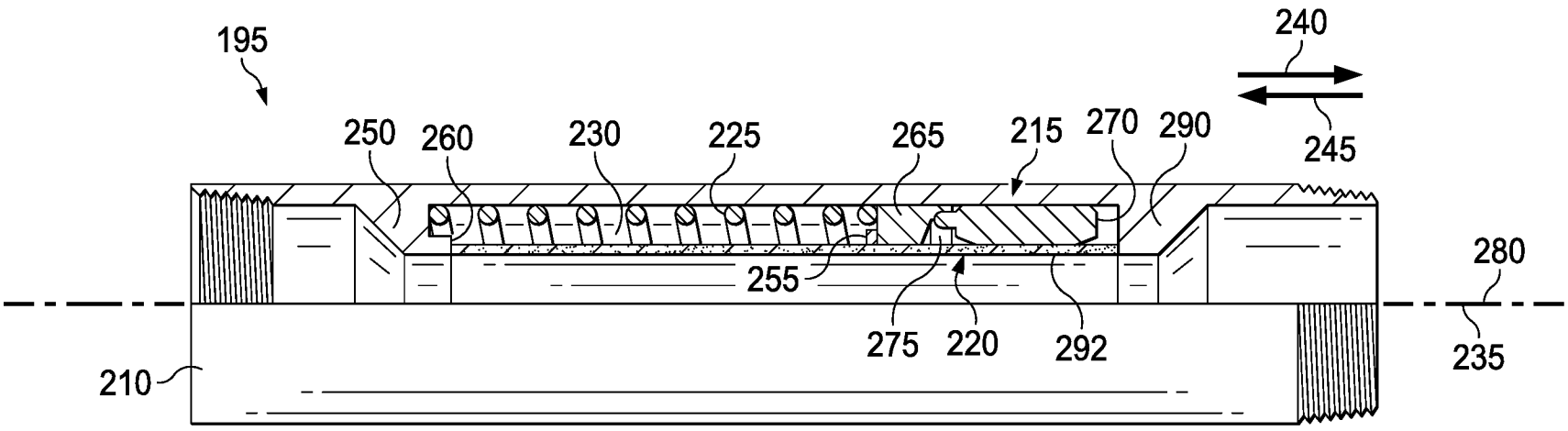
FIG. 2B is a cross-sectional view of another embodiment of the downhole tool of FIG. 1, according to one or more embodiments of the present disclosure.
Figure 2C:
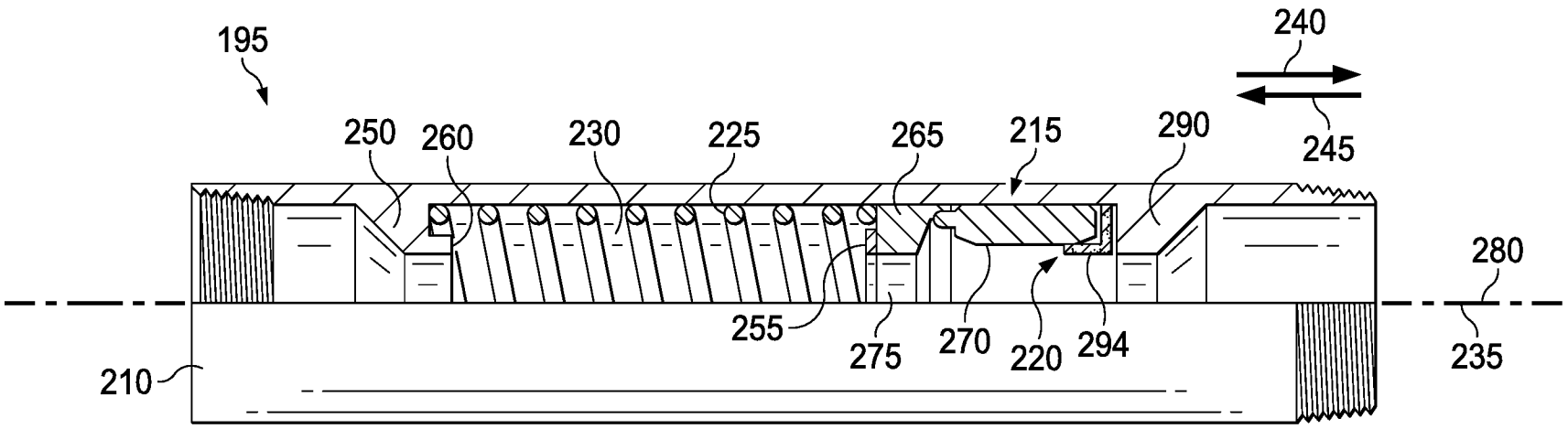
FIG. 2C is a cross-sectional view of yet another embodiment of the downhole tool of FIG. 1, according to one or more embodiments of the present disclosure.

In some embodiments, as in FIG. 2A, the retainer 220 is a sleeve 285 engageable to hold the flapper 270 open. When engaged, the sleeve 285 extends axially between the seat 265 and an internal chock 290, which internal chock 290 may be integrally formed with, or at least fixedly attached to, the housing 210, as shown in FIG. 2A. Alternatively, the internal chock 290 may be integrally formed with, or at least fixedly attached to, the seat 265 itself (e.g., via an annular extension of the seat 265 and/or the internal chock 290), and thus movable together with the flow control device 215 and relative to the housing 210 in the direction 245. In some embodiments, when engaged, the sleeve 285 is operably coupled to the seat 265 and/or the internal chock 290 to hold the flapper 270 open. Turning to FIG. 2B, in other embodiments, the retainer 220 is a sleeve 292 engageable to hold the flapper 270 open. The sleeve 292 is longer than the sleeve 285 so that, when engaged, the sleeve 292 extends axially between the internal chock 250 and the internal chock 290. The extension of the sleeve 292 between the internal chock 250 and the internal chock 290 when the retainer 220 is engaged prevents, or at least reduces, fluid and/or debris passing through the internal passage 230 of the housing 210 from contacting or otherwise obstructing the shock absorber 225. In some embodiments, when engaged, the sleeve 292 is operably coupled to the internal chock 250, the seat 265, and/or the internal chock 290 to hold the flapper 270 open and to prevent, or at least reduce, fluid and/or debris passing through the internal passage 230 of the housing 210 from contacting or otherwise obstructing the shock absorber 225. Turning to FIG. 2C, in still other embodiments, the retainer 220 is a catch 294 engageable to hold the flapper 270 open. More particularly, when engaged, the catch 294 extends between the flapper 270 and an internal surface of the housing 210 (e.g., an inner wall of the housing 210, the internal chock 290, etc.). In some embodiments, when engaged, the catch 294 is operably coupled to the flapper 270 and/or the internal surface of the housing 210 to hold the flapper 270 open.

In some embodiments, the retainer 220 is or includes a dissolvable material such as a metal or an alloy of metals. For example, the retainer 220 may be or include an alkaline earth metal (e.g., Magnesium, Calcium, etc.) or a transition metal (Aluminum, etc.). In some embodiments, the dissolvable material is a magnesium alloy or an aluminum alloy. The dissolution time of the retainer 220 can be accelerated by alloying the metal with dopant(s). Specifically, the dopant(s) can create a galvanic coupling that accelerates the reaction rate or that prevents the formation of a passivation layer. For example, the dopant(s) may be alloyed into the metal, may be included as a granular inclusion, or may be the result of a powder metallurgical construction. In any case, the dopant(s) may be or include any material that has a higher galvanic charge than the base metal from which the retainer 220 is constructed (e.g., copper, iron, tungsten, carbon, calcium, etc.). In other embodiments, the dissolvable material from which the retainer 220 is constructed may be a polymer such as an aliphatic polyester that contains a hydrostable ester bond. Examples of such polymers include polylactic acid ("PLA") (e.g., obtained from plycondensation of D- or L-lactic acid or from ring opening polymerization of lactide, which leads to semicrystalline PLLA and amorphous PDLLA) (generally, a lower level of crystallinity is desired in order to promote degradation), polyglycolide ("PGA") and poly(lactic-co-glycolide) ("PLGA"), polycaprolactone ("PCL"), and polyhydroxyalkonate. Other suitable polymers includes polyurethane, natural rubber, acrylic, thiol, acrylate, and butyl rubber.

Figure 3:
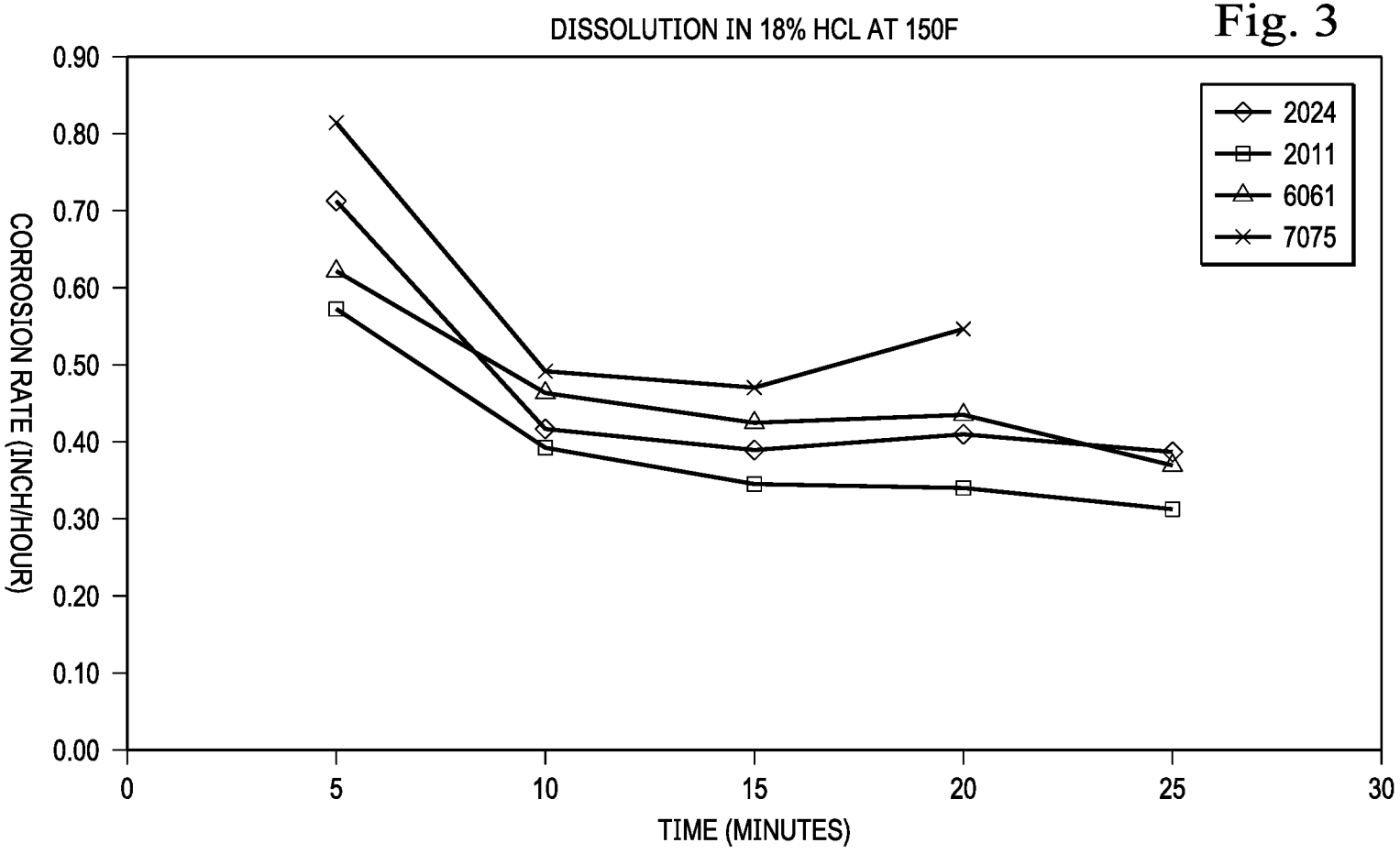
FIG. 3 is a graphical view of the dissolution rates of various materials from which at least respective portions of the downhole tool of FIGS. 1, 2A, 2B, and 2C may be constructed, according to one or more embodiments of the present disclosure.

The reaction rate of the dissolvable retainer 220 can be delayed through the use of coating(s) on the surface of the material. For example, a latex coating, a paint, an elastomer, a plastic, a metal, or an epoxy may be used to prevent premature closing of the flow control device 215 (e.g., the flapper valve). The dissolution fluid (e.g., the spacer fluid, the cement slurry, the drilling fluid, etc.) is used to promote the rapid dissolution of the retainer 220. An example dissolution fluid is or includes an acid with a pH level of less than 5. Such an acid may be or include hydrochloric acid, formic acid, citric acid, carboxylic acid, or the like. In some embodiments, the acid is an anhydrous acid that has a slow release time such as, for example, Halliburton's N-FIow™ filter cake breaker system. The dissolution fluid can also be a brine containing, for example, chlorine ions such as from a NaCl or KCl brine. The dissolution fluid can also be a brine mixed with an acid. For example, a magnesium alloy that is combined with a dopant will dissolve in citric acid at a rate of approximately 40 $mg/cm^2$/hour while the same material dissolves at 70 $mg/cm^2$/hour in a citric acid combined with 3% KCl. In another example, aluminum alloy that is not doped will dissolve at approximately 0.5 inches/hour when immersed in 18% HCl at 150 F. A lower concentration of acid will slow the dissolution rate. Example corrosion rates in 18% HCl at 150 F for various materials are charted in FIG. 3 for alloys of aluminum including 2024 aluminum alloy with copper as the main alloying elements, 2011 aluminum alloy with copper as the main alloying element, 6061 aluminum alloy with magnesium and silicon as the main alloying elements, and 7075 aluminum alloy with zinc as the main alloying element.

In some embodiments, the retainer 220 is made of a dissolvable metal. In other embodiments, the retainer 220 is made of a dissolvable or degradable elastomer. In some embodiments, the retainer 220 is a polymer that is pH responsive so that, as pH increases, the retainer 220 degrades and allows the flow control device 215 to close. In some embodiments, the flow control device 215 is actuated using an RFID or electromagnetics-based sensor, and/or a radioactive tracer or other chemical reaction that degrades the retainer 220. The flow control device 215 may be in the form of an expandable member that expands upon being exposed to certain stimuli. Alternatively, the flow control device 215 may be in the form of a poppet valve that is retained off of its seat by a dissolvable material (e.g., a dissolvable metal), the dissolution of which allows the poppet valve to close.

Figure 4A:
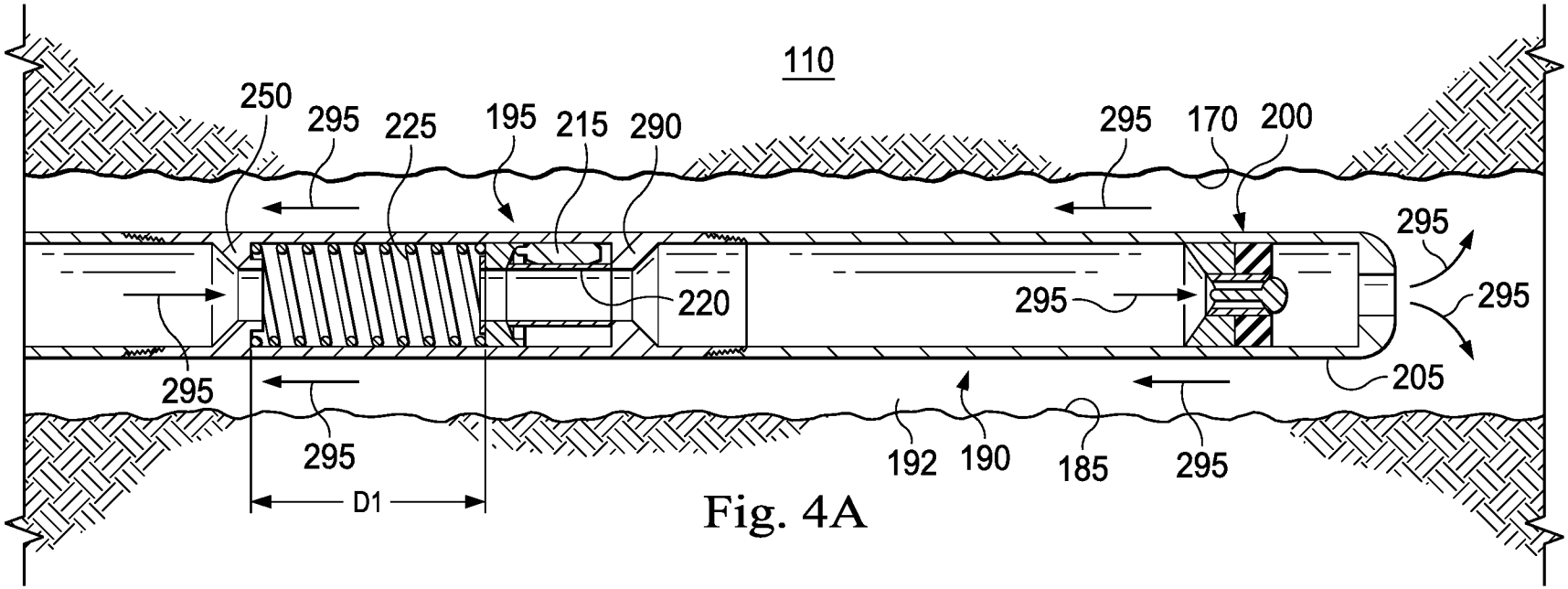
FIG. 4A is a cross-sectional view of a tubular string including the downhole tool of FIG. 2A, the tubular string being configured in a first operational state, according to one or more embodiments of the present disclosure.

Referring to FIGS. 4A-4D, in operation, the downhole tool 195 is operable during the process of cementing the tubular string 190 into the wellbore 170 to prevent, or at least reduce, the flow of cement slurry into the tubular string 190 from the annulus 192 and to absorb pulses created by increasing pressure in the annulus 192. Turning to FIG. 4A, the tubular string 190 is run in hole and secured to the lower end portion of the casing 180 via the hanger (not shown) so that the tubular string 190 extends downhole from the casing 180 (shown in FIG. 1) and into the open-hole portion 185 of the wellbore 170. The tubular string 190 includes the downhole tool 195, which itself includes the flow control device 215 (e.g., the flapper valve) held open by the retainer 220

Figure 4B:
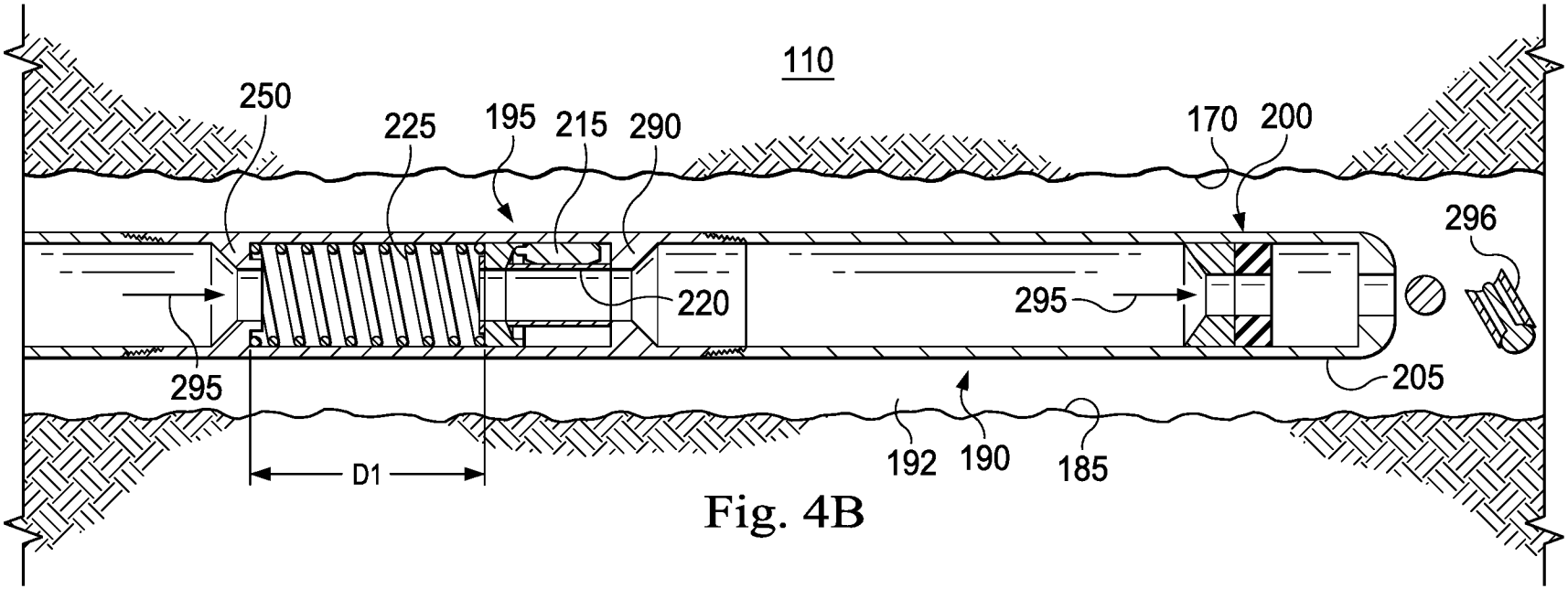
FIG. 4B is a cross-sectional view of the tubular string of FIG. 4A configured in a second operational state, according to one or more embodiments of the present disclosure.

(e.g., a dissolvable sleeve or catch), and the shock absorber 225 (e.g., the spring shock absorber, the hydraulic shock absorber, the elastomeric shock absorber, another type of shock absorber, or any combination thereof) associated with the flow control device 215 to absorb a pressure pulse in the wellbore. While running the tubular string 190 in hole, the valve 200 (e.g., the pump out float valve such as a poppet valve) (positioned above or below the downhole tool 195) permits conventional circulating of the well, as indicated by arrows 295. Turning to FIG. 4B, after the tubular string 190 is positioned in the open-hole portion 185 of the wellbore 170, the valve 200 is opened (e.g., the poppet valve is sheared off using a dropped ball) to permit fluid flow from the annulus 192 uphole into the tubular string 190. In those instances where the valve 200 is a poppet valve, positioning the poppet valve below the downhole tool 195 permits a sheared portion 296 of the poppet valve to fall into the rat hole more easily. During the running in of the tubular string 190 and the positioning of the tubular string 190 in the open-hole portion 185 of the wellbore 170, the flow control device 215 is spaced apart from the internal chock 250 by a distance D1, as shown in FIGS. 4A and 4B.

Figure 4C:
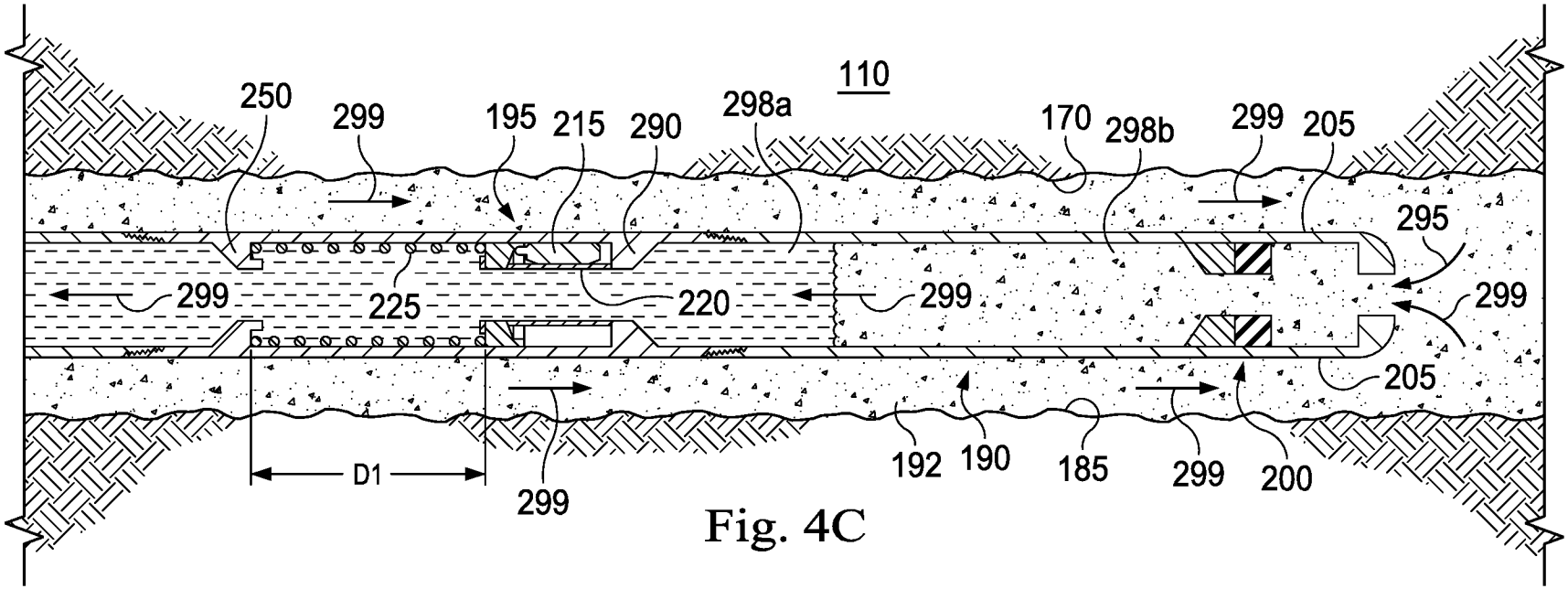
FIG. 4C is a cross-sectional view of the tubular string of FIGS. 4A-B configured in a third operational state, according to one or more embodiments of the present disclosure.
Figure 4D:
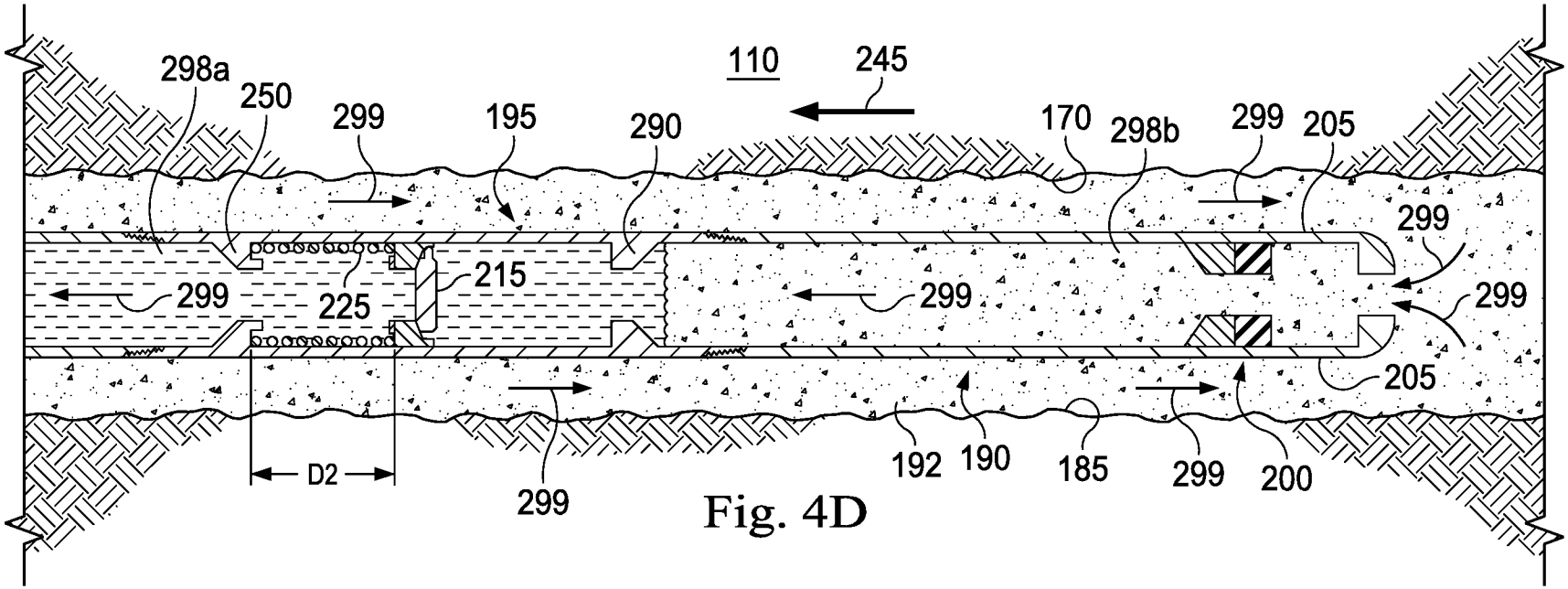
FIG. 4D is a cross-sectional view of the tubular string of FIGS. 4A-C configured in a fourth operational state, according to one or more embodiments of the present disclosure.

Turning to FIG. 4C, once the valve 200 has been opened and the tubular string 190 is ready to be reverse circulation cemented into the wellbore 170, a spacer fluid 298*a* (e.g., containing the dissolution fluid) is pumped down the annulus 192 between the tubular string 190 and the wellbore 170, which spacer fluid 298*a* is followed by a cement slurry 298*b*, as indicated by arrows 299. The volume of the spacer fluid 298*a* pumped down the annulus 192 is sized so that it can completely dissolve the retainer 220 (e.g., the dissolvable sleeve 285, 292 or catch 294) holding open the flow control device 215 (e.g., the flapper valve) by the time the cement slurry 298*b* has filled a shoe track of the shoe 205 at the bottom portion of the tubular string 190. In those embodiments in which the retainer 220 is dissolvable, the retainer 220 is used to prevent the flow control device 215 from closing until the spacer fluid 298*a* (i.e., containing a dissolution fluid) is pumped proximate the dissolvable retainer 220. For example, the dissolvable retainer 220 may be used to cover only the flapper 270 of the flapper valve (shown in FIG. 2A), to cover both the flapper 270 and the shock absorber 225 (shown in FIG. 2B), or as the catch 294 to prevent the flapper 270 of the flapper valve from moving (i.e., a hook rather than a shield). Turning to FIG. 4D, upon dissolution of the retainer 220, the flow control device 215 closes and the shock absorber 225 associated with the flow control device 215 compresses to dissipate energy created by the fluid momentum of the cement slurry 298*b*, thereby reducing the risk of a pressure pulse fracturing the surrounding formation 110. Once compressed, the flow control device 215 is spaced apart from the internal chock 250 by a distance D2, which is less than the distance D1, as shown in FIG. 4D. More particularly, the flow control device 215 moves axially relative to the tubular string in the direction 245 while the shock absorber dampens the movement of the flow control device 215 in the direction 245. In those embodiments, as in FIG. 4D, in which the internal chock 290 is integrally formed with the housing 210, the internal chock 290 remains stationary while the flow control device 215 moves axially in the direction 245 relative to the tubular string 190. Alternatively, in those embodiments in which the internal chock 290 is integrally formed with, or at least fixedly attached to, the seat 265 (e.g., via the annular extension of the seat 265 and/or the internal chock 290), the internal chock 290 moves together with the flow control device 215 and relative to the tubular string 290 in the direction 245.

Figure 5:
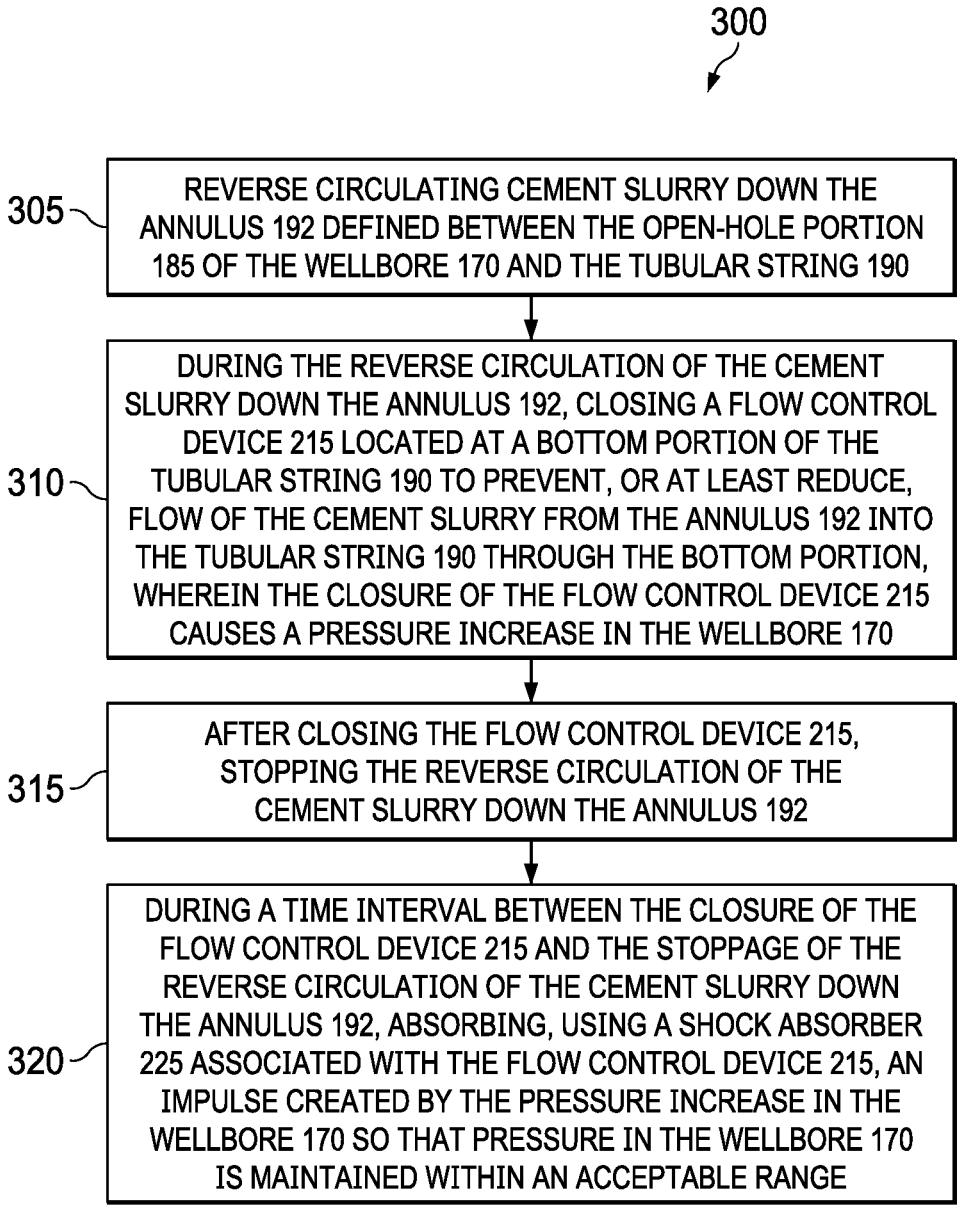
FIG. 5 is a flow diagram of a method for implementing one or more embodiments of the present disclosure.

Referring to FIG. 5, a method of cementing the tubular string 190 into the wellbore 170 is generally referred to by the reference numeral 300. The method 300 is executed after the tubular string 190 is secured to the lower end portion of the casing 180 via the hanger (not shown) so that the tubular string 190 extends downhole from the casing 180 and into the open-hole portion 185 of the wellbore 170. The method 300 includes at a step 305 reverse circulating cement slurry down the annulus 192 defined between the open-hole portion 185 of the wellbore 170 and the tubular string 190 extending within the wellbore 170. During the circulation of the cement slurry down the annulus 192, the method 300 may further include determining that a level of the cement slurry in the annulus 192 and/or the tubular string 190 has reached a threshold. At a step 310, during the reverse circulation of the cement slurry down the annulus 192, a flow control device 215 located in the tubular string 190 is closed to prevent, or at least reduce, flow of the cement slurry from the annulus 192 into the tubular string 190 through the bottom portion, wherein the closure of the flow control device 215 causes a pressure pulse in the wellbore 170. In some embodiments of the step 310, the flow control device 215 is or includes a flapper valve. In some embodiments of the step 310, the flow control device 215 is closed in response to the determination that that the level of the cement slurry in the annulus 192 and/or the tubular string 190 has met the threshold. In some embodiments of the step 310, determining that the level of the cement slurry in the annulus 192 and/or the tubular string 190 has met the threshold includes disengaging the retainer 220 that, when engaged, holds the flow control device 215 open.

In some embodiments, as in FIG. 5, closing the flow control device 215 initiates a pressure wave in the wellbore 170 that travels up the annulus 192, and the method 300 further includes detecting the pressure wave in the annulus 192 with a sensor. At a step 315, after closing the flow control device 215, the reverse circulation of the cement slurry down the annulus 192 is stopped. In some embodiments of the step 315, the reverse circulation of cement slurry down the annulus 192 is stopped in response to the detection of the pressure wave in the annulus 192 by the sensor. At a step 320, during a time interval between the closure of the flow control device 215 and the stoppage of the reverse circulation of the cement slurry down the annulus 192, a shock absorber 225 associated with the flow control device 215 absorbs the pressure pulse in the wellbore 170 so that a pressure in the wellbore 170 is maintained within an acceptable range. In some embodiments of the step 320, the shock absorber 225 is or includes a spring. In some embodiments of the step 320, the acceptable range within which the wellbore 170 pressure is maintained by the shock absorber 225 is: above a pore pressure of the subterranean formation 110 through which the wellbore 170 extends; and below a fracturing pressure of the subterranean formation 110. In some embodiments, the flow control device 215 is movable relative to the tubular string 190 upon closure of the flow control device 215 and in response to the resulting pressure pulse in the wellbore 170, and the step 320 includes dampening the movement of the flow control device 215 relative to the tubular string 190 using the shock absorber 225.

In some embodiments, the operation of the downhole tool 195 and/or the execution of the method 300 reduces the critical risk to wellbore integrity posed by the closing of the flow control device 215 during the reverse circulation cementing operation. In some embodiments, the operation of the downhole tool 195 and/or the execution of the method 300 absorbs the high pressure pulse created upon closure of the flow control device 215, thus preventing the high pressure pulse from being transmitted to the formation 110. As a result, fracture of the formation 110 followed by subsequent loss of the cement slurry to the formation 110 is prevented, or at least reduced. In some embodiments, the operation of the downhole tool 195 and/or the execution of the method 300 maintains the ECD within a crucial window between the fracture gradient and the pore-pressure gradient of the formation 110.

A system has been disclosed. The system generally includes a tubular string extending within a wellbore, wherein an annulus down which cement slurry is adapted to be reverse circulated is defined between the tubular string and an inner wall of the wellbore; and a downhole tool located in the tubular string, the downhole tool including: a flow control device adapted to be closed during the reverse circulation of the cement slurry down the annulus to prevent or at least reduce, flow of the cement slurry from the annulus into the tubular string, wherein the closure of the flow control device causes a pressure pulse in the wellbore, and wherein, after the closure of the flow control device, the reverse circulation of the cement slurry down the annulus is adapted to be stopped; and a shock absorber associated with the flow control device, wherein, during a time interval between the closure of the flow control device and the stoppage of the reverse circulation of the cement slurry down the annulus, the shock absorber is adapted to absorb the pressure pulse in the wellbore so that a pressure in the wellbore is maintained within an acceptable range.

The foregoing system embodiment may include one or more of the following elements, either alone or in combination with one another.

- During the circulation of the cement slurry down the annulus, the downhole tool is adapted to determine that a level of the cement slurry in the annulus and/or the tubular string has reached a threshold; and the flow control device is further adapted to be closed in response to the determination that that the level of the cement slurry in the annulus and/or the tubular string has met the threshold.
- The downhole tool further includes a retainer that, when engaged, holds the flow control device open, the retainer being adapted to be disengaged when the level of the cement slurry in the annulus and/or the tubular string has reached the threshold; and the downhole tool is adapted to determine that the level of the cement slurry in the annulus and/or the tubular string has reached the threshold by disengaging the retainer.
- The closure of the flow control device initiates a pressure wave in the wellbore that travels up the annulus; the system further includes a sensor adapted to detect the pressure wave in the annulus; and the circulation of cement slurry down the annulus is adapted to be stopped in response to the detection of the pressure wave in the annulus by the sensor.
- The flow control device is movable relative to the tubular string upon closure of the flow control device and in response to the resulting pressure pulse in the wellbore; and the shock absorber is adapted to absorb the pressure pulse in the wellbore by dampening the movement of the flow control device relative to the tubular string.
- The acceptable range within which the wellbore pressure is maintained by the shock absorber is: above a pore pressure of a subterranean formation through which the wellbore extends; and below a fracturing pressure of the subterranean formation.
- The flow control device is or includes a flapper valve; and/or the shock absorber is or includes a spring.

A method has also been disclosed. The method generally includes reverse circulating cement slurry down an annulus defined between an inner wall of a wellbore and a tubular string extending within the wellbore; during the reverse circulation of the cement slurry down the annulus, closing a flow control device located in the tubular string to prevent, or at least reduce, flow of the cement slurry from the annulus into the tubular string, wherein the closure of the flow control device causes a pressure pulse in the wellbore; after closing the flow control device, stopping the reverse circulation of the cement slurry down the annulus; and during a time interval between the closure of the flow control device and the stoppage of the reverse circulation of the cement slurry down the annulus, absorbing, using a shock absorber associated with the flow control device, the pressure pulse in the wellbore so that a pressure in the wellbore is maintained within an acceptable range.

The foregoing method embodiment may include one or more of the following elements, either alone or in combination with one another:

- The method further includes, during the circulation of the cement slurry down the annulus, determining that a level of the cement slurry in the annulus and/or the tubular string has reached a threshold; wherein the flow control device is closed in response to the determination that that the level of the cement slurry in the annulus and/or the tubular string has met the threshold.
- Determining that the level of the cement slurry in the annulus and/or the tubular string has met the threshold includes disengaging a retainer that, when engaged, holds the flow control device open.
- Closing the flow control device initiates a pressure wave in the wellbore that travels up the annulus; the method further includes detecting the pressure wave in the annulus; and the circulation of cement slurry down the annulus is stopped in response to the detection of the pressure wave in the annulus.
- The flow control device is movable relative to the tubular string upon closure of the flow control device and in response to the resulting pressure pulse in the wellbore; and absorbing, using the shock absorber associated with the flow control device, the pressure pulse in the wellbore includes dampening movement of the flow control device relative to the tubular string using the shock absorber.
- The acceptable range within which the wellbore pressure is maintained by the shock absorber is: above a pore pressure of a subterranean formation through which the wellbore extends; and below a fracturing pressure of the subterranean formation.
- The flow control device is or includes a flapper valve; and/or the shock absorber is or includes a spring.

An apparatus has also been disclosed. The apparatus generally includes a tubular housing; a flow control device extending within the tubular housing, wherein the flow control device is axially movable within the tubular housing in at least a first direction, and wherein the flow control device is closable to prevent, or at least reduce, fluid flow through the tubular housing in the first direction; a retainer that, when engaged, holds the flow control device open, wherein the retainer is adapted to be disengaged when a characteristic of a fluid in the tubular housing has reached a threshold; and a shock absorber associated with the flow control device, wherein, upon closure of the flow control device, the shock absorber is adapted to dampen the axial movement of the flow control device within the tubular housing in the first direction.

The foregoing apparatus embodiment may include one or more of the following elements, either alone or in combination with one another:

The flow control device is or includes a flapper valve; and/or the shock absorber is or includes a spring.

The apparatus further includes a first internal chock integrally formed with, or at least fixedly attached to, the tubular housing; wherein the shock absorber is compressed between the internal chock and the flow control device when the flow control device moves axially in the first direction.

The apparatus further includes a second internal chock; wherein the retainer is operably coupled to the second internal chock.

The second internal chock is integrally formed with, or at least fixedly attached to, the flow control device.

The second internal chock is integrally formed with, or at least fixedly attached to, the tubular housing.

It is understood that variations may be made in the foregoing without departing from the scope of the present disclosure.

In some embodiments, the elements and teachings of the various embodiments may be combined in whole or in part in some or all of the embodiments. In addition, one or more of the elements and teachings of the various embodiments may be omitted, at least in part, and/or combined, at least in part, with one or more of the other elements and teachings of the various embodiments.

Any spatial references, such as, for example, "upper," "lower," "above," "below," "between," "bottom," "vertical," "horizontal," "angular," "upwards," "downwards," "side-to-side," "left-to-right," "right-to-left," "top-to-bottom," "bottom-to-top," "top," "bottom," "bottom-up," "top-down," etc., are for the purpose of illustration only and do not limit the specific orientation or location of the structure described above.

In some embodiments, while different steps, processes, and procedures are described as appearing as distinct acts, one or more of the steps, one or more of the processes, and/or one or more of the procedures may also be performed in different orders, simultaneously and/or sequentially. In some embodiments, the steps, processes, and/or procedures may be merged into one or more steps, processes and/or procedures.

In some embodiments, one or more of the operational steps in each embodiment may be omitted. Moreover, in some instances, some features of the present disclosure may be employed without a corresponding use of the other features. Moreover, one or more of the above-described embodiments and/or variations may be combined in whole or in part with any one or more of the other above-described embodiments and/or variations.

Although some embodiments have been described in detail above, the embodiments described are illustrative only and are not limiting, and those skilled in the art will readily appreciate that many other modifications, changes and/or substitutions are possible in the embodiments without materially departing from the novel teachings and advantages of the present disclosure. Accordingly, all such modifications, changes, and/or substitutions are intended to be included within the scope of this disclosure as defined in the following claims. In the claims, any means-plus-function clauses are intended to cover the structures described herein as performing the recited function and not only structural equivalents, but also equivalent structures. Moreover, it is the express intention of the applicant not to invoke 35 U.S.C. § 112, paragraph 6 for any limitations of any of the claims herein, except for those in which the claim expressly uses the word "means" together with an associated function.

What is claimed is:

1. A method, comprising:

reverse circulating cement slurry down an annulus defined between an inner wall of a wellbore and a tubular string extending within the wellbore;

during the reverse circulation of the cement slurry down the annulus, closing a flow control device located in the tubular string to prevent, or at least reduce, flow of the cement slurry from the annulus into the tubular string, wherein the closure of the flow control device causes a pressure pulse in the wellbore;

after closing the flow control device, stopping the reverse circulation of the cement slurry down the annulus; and during a time interval between the closure of the flow control device and the stoppage of the reverse circulation of the cement slurry down the annulus, absorbing, using a shock absorber associated with the flow control device, the pressure pulse in the wellbore so that a pressure in the wellbore is maintained within an acceptable range, wherein closing the flow control device initiates a pressure wave in the wellbore that travels up the annulus;

wherein the method further comprises detecting the pressure wave in the annulus; and wherein the circulation of cement slurry down the annulus is stopped in response to the detection of the pressure wave in the annulus.

2. The method of claim 1, further comprising:

during the circulation of the cement slurry down the annulus, determining that a level of the cement slurry in the annulus and/or the tubular string has reached a threshold;

wherein the flow control device is closed in response to the determination that that the level of the cement slurry in the annulus and/or the tubular string has met the threshold.

3. The method of claim 2, wherein determining that the level of the cement slurry in the annulus and/or the tubular string has met the threshold comprises disengaging a retainer that, when engaged, holds the flow control device open.

4. The method of claim 1, wherein the flow control device is movable relative to the tubular string upon closure of the flow control device and in response to the resulting pressure pulse in the wellbore; and wherein absorbing, using the shock absorber associated with the flow control device, the pressure pulse in the wellbore comprises dampening movement of the flow control device relative to the tubular string using the shock absorber.

5. The method of claim 1, wherein the acceptable range within which the wellbore pressure is maintained by the shock absorber is:

above a pore pressure of a subterranean formation through which the wellbore extends; and below a fracturing pressure of the subterranean formation.

6. The method of claim 1, wherein:

the flow control device comprises a flapper valve; or the shock absorber comprises a spring.

7. A system, comprising:

a tubular string extending within a wellbore, wherein an annulus through which cement slurry is adapted to be reverse circulated is defined between the tubular string and an inner wall of the wellbore; and a downhole tool located in the tubular string, the downhole tool comprising:

a flow control device adapted to be closed during the reverse circulation of the cement slurry down the annulus to prevent or at least reduce, flow of the cement slurry from the annulus into the tubular string, wherein the closure of the flow control device causes a pressure pulse in the wellbore, and wherein, after the closure of the flow control device, the reverse circulation of the cement slurry down the annulus is adapted to be stopped; and a shock absorber associated with the flow control device, wherein, during a time interval between the closure of the flow control device and the stoppage of the reverse circulation of the cement slurry down the annulus, the shock absorber is adapted to absorb the pressure pulse in the wellbore so that a pressure in the wellbore is maintained within an acceptable range, wherein the circulation of cement slurry down the annulus is adapted to be stopped in response to detection of the pressure wave.

8. The system of claim 7, wherein, during the circulation of the cement slurry down the annulus, the downhole tool is adapted to determine that a level of the cement slurry in the annulus and/or the tubular string has reached a threshold; and wherein the flow control device is further adapted to be closed in response to the determination that that the level of the cement slurry in the annulus and/or the tubular string has met the threshold.

9. The system of claim 8, wherein the downhole tool further comprises a retainer that, when engaged, holds the flow control device open, the retainer being adapted to be disengaged when the level of the cement slurry in the annulus and/or the tubular string has reached the threshold; and wherein the downhole tool is adapted to determine that the level of the cement slurry in the annulus and/or the tubular string has reached the threshold by disengaging the retainer.

10. The system of claim 7, wherein the flow control device is movable relative to the tubular string upon closure of the flow control device and in response to the resulting pressure pulse in the wellbore; and wherein the shock absorber is adapted to absorb the pressure pulse in the wellbore by dampening the movement of the flow control device relative to the tubular string.

11. The system of claim 7, wherein the acceptable range within which the wellbore pressure is maintained by the shock absorber is:

above a pore pressure of a subterranean formation through which the wellbore extends; and below a fracturing pressure of the subterranean formation.

12. The system of claim 7, wherein: the flow control device comprises a flapper valve; or the shock absorber comprises a spring.

13. An apparatus, comprising:

a tubular housing;

a flow control device extending within the tubular housing, wherein the flow control device is axially movable within the tubular housing in at least a first direction, and wherein the flow control device is closable to prevent, or at least reduce, fluid flow through the tubular housing in the first direction;

a retainer that, when engaged, holds the flow control device open, wherein the retainer is adapted to be disengaged when a characteristic of a fluid in the tubular housing has reached a threshold;

a shock absorber associated with the flow control device, wherein, upon closure of the flow control device, the shock absorber is adapted to dampen the axial movement of the flow control device within the tubular housing in the first direction;

a first internal chock integrally formed with, or at least fixedly attached to, the tubular housing, wherein the shock absorber is compressed between the internal chock and the flow control device when the flow control device moves axially in the first direction; and a second internal chock, wherein the retainer is operably coupled to the second internal chock.

14. The apparatus of claim 13, wherein: the flow control device comprises a flapper valve; or the shock absorber comprises a spring.

15. The apparatus of claim 13, wherein the second internal chock is integrally formed with, or at least fixedly attached to, the flow control device.

16. The apparatus of claim 13, wherein the second internal chock is integrally formed with, or at least fixedly attached to, the tubular housing.

* * * * *